US010156204B2

(12) United States Patent
Cale et al.

(10) Patent No.: US 10,156,204 B2
(45) Date of Patent: Dec. 18, 2018

(54) ATTACHMENT OF CYLINDERS IN THE HOUSING OF FREE-PISTON STIRLING MACHINES

(71) Applicant: Sunpower, Inc., Athens, OH (US)

(72) Inventors: E. Todd Cale, Coolville, OH (US); John Stanley, Athens, OH (US)

(73) Assignee: Sunpower, Inc., Athens, OH (US)

( * ) Notice: Subject to any disclaimer, the term of this patent is extended or adjusted under 35 U.S.C. 154(b) by 74 days.

(21) Appl. No.: 15/494,690

(22) Filed: Apr. 24, 2017

(65) Prior Publication Data

US 2018/0306140 A1 Oct. 25, 2018

(51) Int. Cl.
*F02G 1/053* (2006.01)
*F02G 1/043* (2006.01)

(52) U.S. Cl.
CPC ..... *F02G 1/0435* (2013.01); *F02G 1/0535* (2013.01)

(58) Field of Classification Search
CPC .... F02G 1/053; F02G 1/0535; F02G 2270/55; F02G 2270/005; F02G 2270/30; F02G 2270/42; F02G 2270/80; F05C 2225/08; F16J 13/065; F04B 39/0005; F04B 39/0044; F04B 39/121; F04B 39/127; F04B 2203/04; F01L 2810/03; F25B 2500/221
USPC ..... 60/517, 264, 368, 379; 62/6
See application file for complete search history.

(56) References Cited

U.S. PATENT DOCUMENTS 5,763,859 A * 6/1998 Wirz ..... D02J 13/005 219/469
7,744,133 B2 6/2010 Wood et al.
2001/0049938 A1 12/2001 Urasawa et al.
2005/0166604 A1 8/2005 Park
2013/0074490 A1 3/2013 Narisawa et al.

FOREIGN PATENT DOCUMENTS

WO 0227175 A1 4/2002

* cited by examiner

*Primary Examiner* — Phutthiwat Wongwian
*Assistant Examiner* — Edward Bushard
(74) *Attorney, Agent, or Firm* — Frank H. Foster; Kremblas & Foster

(57) ABSTRACT

An improvement to a free-piston Stirling machine having a cylinder mounted within a housing. The cylinder has a flange for mounting the cylinder within the housing to a transition plate with a central opening for receiving the cylinder. An elastic rim bounds and surrounds the opening and extends in an axial direction from the plate to a crest of the rim. The crest of the rim is in contact against a first axially facing side of the cylinder flange. The interior side of the rim is outwardly spaced from the exterior side of the cylinder. A compliant clamp is attached to the transition plate and is positioned on the opposite, axially facing side of the cylinder flange. The compliant clamp has an elastic spring extending against the cylinder flange which applies a force urging the cylinder flange in an axial direction against the crest of the elastic rim.

7 Claims, 2 Drawing Sheets

Fig. 1 Prior Art
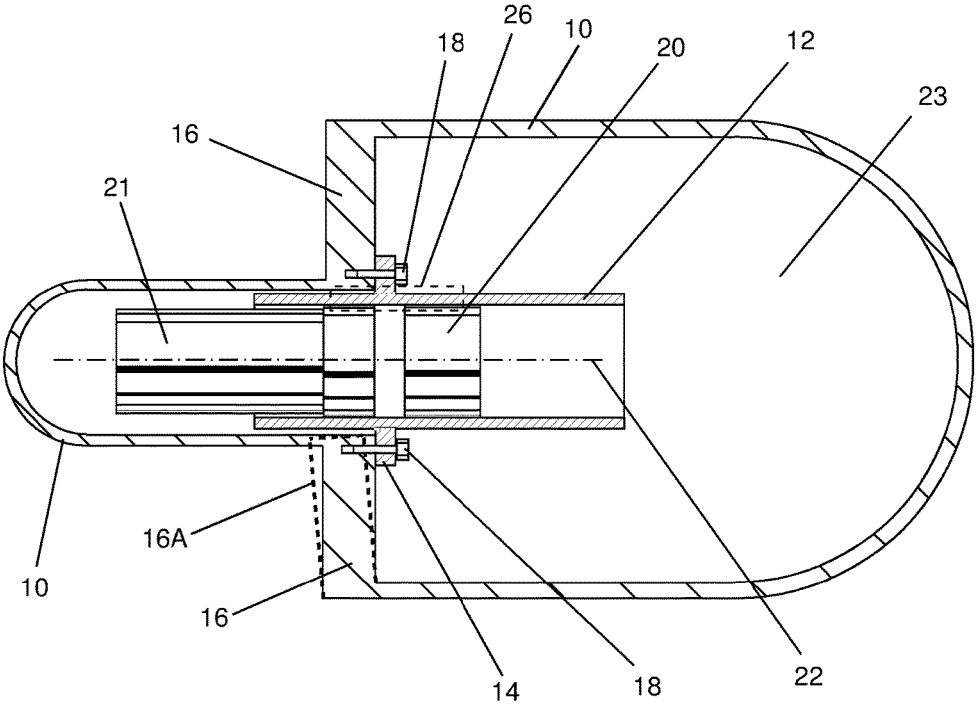
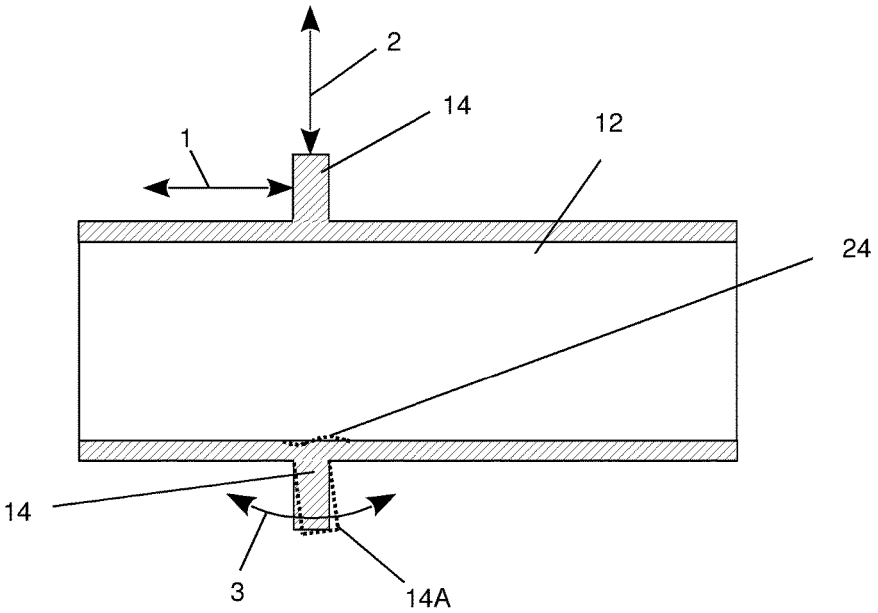
Fig. 2 Prior Art

Fig. 3
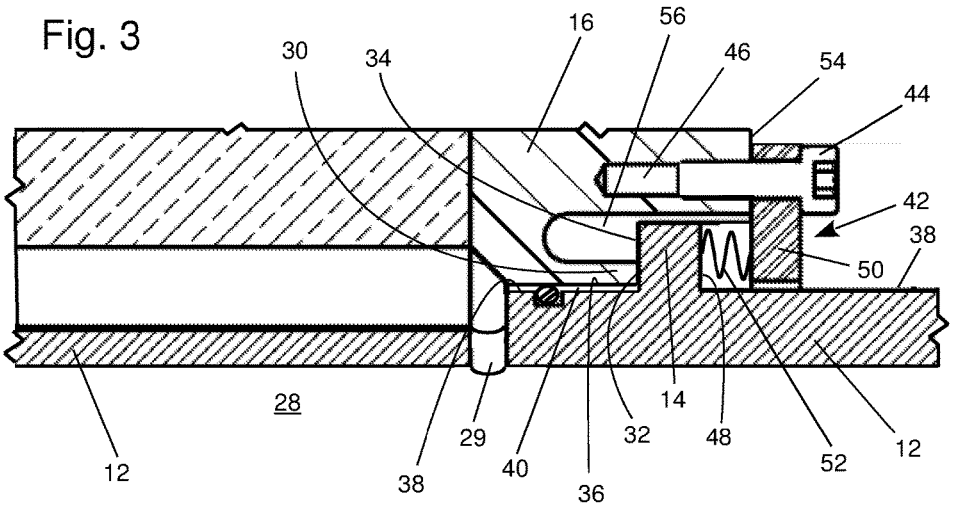
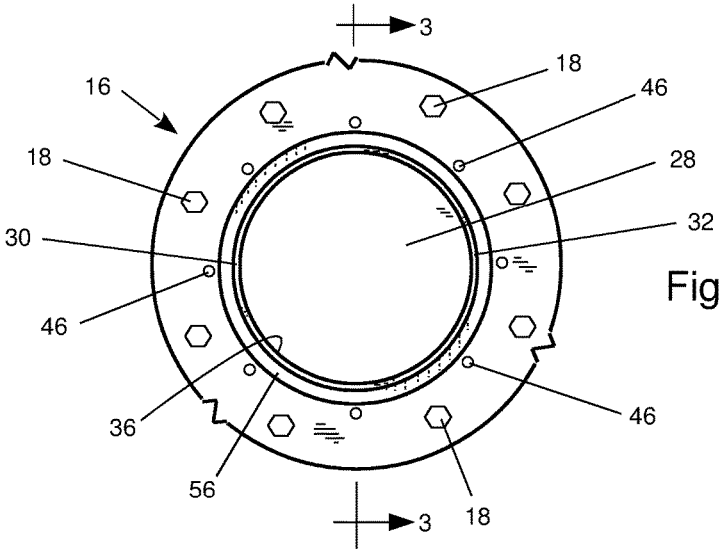
Fig. 4
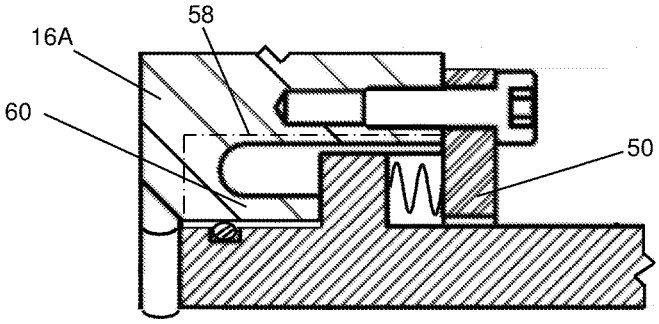
Fig. 5

ATTACHMENT OF CYLINDERS IN THE HOUSING OF FREE-PISTON STIRLING MACHINES

STATEMENT REGARDING FEDERALLY-SPONSORED RESEARCH AND DEVELOPMENT

This invention was made with Government support under contract ARPA-E GENSETS Assistance Agreement # DE-AR0000604 awarded by DOE. The Government has certain rights in the invention.

CROSS-REFERENCES TO RELATED APPLICATIONS (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to free-piston Stirling machines which include free-piston Stirling engines, heat pumps, coolers and cryocoolers. More particularly, the invention is directed to compact structures for attaching the cylinder, in which a piston reciprocates, to the interior of the pressurized housing for the machine. The invention compensates for distortion or movement of component parts of the housing as a result of heat or pressurization by allowing the cylinder to move with the housing component in the direction in which it needs to move with the housing component but also prevents movement and physical distortion of the cylinder as a result of housing movement or distortion in directions that, if applied to the cylinder, would distort the cylinder or otherwise harmfully damage the machine or its operation.

FIG. 1 illustrates some components of a free-piston Stirling machine having a housing 10 and a cylinder 12. Other components, such as the regenerator and a drive motor or driven load, are omitted because they are not a part of the invention and are well known in the prior art. The cylinder 12 has a cylinder flange 14, which may be an annular mounting flange, for attachment of the cylinder 12 to the housing 10. The cylinder flange 14 is attached to a housing transition plate 16 by a series of circularly spaced machine screws 18. As seen in the drawing, the transition plate 16 has a thicker metal wall for strength and resisting distortion and makes the transition between portions of the housing 10 that have different diameters. A piston 20 reciprocates in the cylinder 12 along a central axis 22 of reciprocation. Similarly, a displacer 21 also reciprocates in the cylinder 12 along the central axis 22 of reciprocation. The housing 10 is filled with a pressurized working gas in the well-known manner. The working space in the housing 10 for a Stirling engine or for a heat pump, cooler or cryocooler is located, in FIG. 1, to the left of the piston 20 and the transition plate 16. The space 23 in the housing 10 that is to the right of the piston 20 and the transition plate 16 is the back space or bounce space. This back space 23 in a Stirling engine contains the load that is driven by the engine, such as an alternator. In a heat pump, cooler or cryocooler, the back space 23 typically contains a motor, such as a linear motor, for driving the Stirling machine.

Free-piston Stirling machines typically use close-running clearance seals. That means that the clearance gap between the piston 20 and the cylinder 12 is small in order to minimize leakage through the clearance gap and to allow the effective use of gas bearings. However, free-piston Stirling machines are also subjected to extreme temperatures and to substantial temperature differences between component parts of the same machine. Additionally, in order to increase their specific power, Stirling machines are most often pressurized to a mean pressure of 3.0 MPa (450 psi) or more. Consequently, the machine and many of its component parts become physically distorted as a result of the pressurization, thermal expansion and differing thermal expansion rates of adjacent parts. The distortion of the housing 10 and of any intermediate structures connected between the housing 10 and the cylinder 12 can apply forces against the cylinder flange 14 and/or the cylinder 12 and thereby cause the cylinder 12 to move and/or distort. Because the piston to cylinder clearance gap is so small, physical distortion of the cylinder often leads to the piston rubbing against the cylinder.

FIGS. 1 and 2 illustrate a basic, prior art arrangement for attaching the cylinder 12 to a housing 10 in the manner described above. There are three directions of distortion movement that can be considered and are illustrated in FIG. 2. If the housing 10 distorts in a manner that applies a force causing the cylinder 12 and its flange 14 to move in the direction of axial translation 1 (i.e. parallel to the central axis of reciprocation 22), the cylinder 12 and its flange 14 need to move in that direction with the transition plate 16 in order to maintain the proper operation of the free-piston Stirling machine. However, in order to maintain the proper operation of the free-piston Stirling machine, if the housing, importantly including the transition plate 16, moves or distorts in the direction of radial translation 2 or in the direction of radial rotation 3, no part of the cylinder 12 or its cylinder flange 14 should be moved or distorted by that housing movement or distortion. [radial rotation 3 is the direction of movement of the transition plate 16 or the cylinder flange 14 by which radials from the central axis 22 through the transition plate 16 or the cylinder flange 14 move from being perpendicular to the central axis 22 to making an acute angle with that perpendicular.]

As an example of one form of distortion, which is quantitatively exaggerated in FIGS. 1 and 2 for visibility, when the housing 10 is pressurized, the transition plate 16 moves in a direction of radial rotation 3 to a position 16A becoming frusto-conical. With the cylinder flange 14 bolted to the transition plate 16, the cylinder flange 14 is also bent with it in a direction of radial rotation 3 to the position 14A (FIG. 2). That radial rotation 3 of the cylinder flange 14 causes the interior wall of the cylinder 12 to be distorted from a cylindrical surface to a distorted contoured surface 24. Since that occurs annularly around the cylinder 12, an axial interval of the cylinder becomes necked down; that is, pushed inward along a circular area forming an annular restriction of reduced cylinder diameter. The result is that the piston 20 would rub on that restriction. In order to avoid the rubbing, the end segment or nose of the piston can be machined to a smaller diameter to avoid the rub but that also increases seal leakage between the piston and cylinder. An alternative is to abrade or machine the interior wall of the cylinder to reduce or remove the restriction. However, this distortion is not present when the machine is depressurized and opened and moreover the area of rub is more difficult to see since this is down inside a bore. Additionally, when machining the interior of a cylinder, the cylinder wall moves out under the force of the machining tool and returns inward when the tool is removed. But the thicker part of the cylinder wall, and especially the cylinder wall directly within the cylinder flange 14, moves out less than the thinner part of the cylinder wall. Consequently the thicker part of the cylinder wall, and especially the cylinder wall directly within the cylinder flange 14, ends up with a larger diameter than the thinner parts of the cylinder wall. That variation in cylinder diameter can be alleviated or substantially reduced if the cylinder flange has circularly spaced discontinuities in its radius in the nature of castling or scallops. As can be visualized by those skilled in the art, an examination of the shape of the housing 10 reveals that pressurization and heat also cause distortion in the direction of axial translation 1 and in the direction of radial translation 2.

The goal of a cylinder mounting technique is to minimize how much the housing distortion in turn distorts the critical engine running surfaces, especially the interior of the cylinder. In particular, the cylinder 12 should be attached so that, when the housing 10 distorts, that distortion will not distort the cylinder 12. However, an additional requirement is that the cylinder 12 be relatively firmly fixed axially to the housing so the cylinder 12 does not move axially relative to the transition plate 16 when the Stirling machine is pressurized and heated or during operation when a cyclic pressure force is acting on the cross-sectional area of the cylinder.

The prior art recognized that the above-described distortion problems exist if the cylinder 12 is directly and rigidly attached to the housing 10 as illustrated in FIG. 1. One type of prior art solution has been to use an intermediate connecting member where connection length is primarily used to isolate the cylinder from the distortion of the housing. For example, a clamping cylinder can be fit coaxially over and surrounding the piston cylinder and have an outward extending flange at one end for attachment to the transition plate 16 and an inward extending flange at its opposite end for clamping against the end of the cylinder. The axial length of the clamping cylinder and a gap provided between the interior of the clamping cylinder and the exterior of the engine cylinder together allow movement of the cylinder in the radial and radial rotation directions. Although length is used to isolate both the radial rotation and radial expansion of the housing from the cylinder, these lengthy connections occupy radial space outward from the engine cylinder which then requires that the housing and a drive motor or mechanical load must have a larger diameter. Another prior art solution is to significantly thicken the engine cylinder to help reduce distortion by making it stronger. That solution, however, adds substantial weight and cost to the Stirling machine.

It is therefore an object and purpose of the invention to provide a cylinder mounting structure that attaches the cylinder to the housing so that the cylinder (1) remains stationery with respect to the housing (moves with the housing) in response to distortion in the axial direction 1, (2) is not distorted or otherwise affected by housing distortion in the direction of radial translation 2 and (3) is not distorted or otherwise affected by housing distortion in the direction of radial rotation 3.

BRIEF SUMMARY OF THE INVENTION

The invention is an improvement to a free-piston Stirling machine having a cylinder mounted within a housing. The cylinder has an outwardly extending cylinder flange for mounting the cylinder within the housing and the housing includes a transition plate having an opening with a central axis for mounting the cylinder within the opening. The invention has an elastic rim bounding and surrounding the opening and extending from the plate to a crest of the rim. The crest of the rim is in contact against a first axially facing side of the cylinder flange. The interior side of the rim is outwardly spaced from the exterior side of the cylinder. A compliant clamp is attached to the transition plate and is positioned on the opposite, axially facing side of the cylinder flange. The compliant clamp has an elastic spring extending against the cylinder flange which applies a force urging the cylinder flange in an axial direction against the crest of the elastic rim.

BRIEF DESCRIPTION OF THE SEVERAL VIEWS OF THE DRAWINGS

FIG. 1 is a symbolic view in axial section of a prior art Stirling machine having components that are used with the invention.

FIG. 2 is a view in section of the cylinder shown in FIG. 1.

FIG. 3 is a view in section of a segment of the Stirling engine in FIG. 1 but modified in accordance with the invention and taken along the line 3-3 of FIG. 4.

FIG. 4 is an end view of a portion of a transition plate of a Stirling machine showing some of the structural features of the invention.

FIG. 5 is a view similar to FIG. 3 but illustrating an alternative embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

The preferred embodiment of the invention is illustrated in FIGS. 3 and 4 and is a modification of a free-piston Stirling machine like that illustrated in FIG. 1. FIGS. 3 and 4 illustrate a modified and enlarged version of the portion of FIG. 1 that is in the rectangle 26 in FIG. 1. FIG. 3 shows an assembled embodiment of the invention but FIG. 4 shows only the central portion of the transition plate 16 after being modified according to the invention. The cylinder 12 and other components of the preferred embodiment of the invention are removed from FIG. 4 in order to expose the transition plate 16. The plate 16 has an opening 28, like the 16 plate in FIG. 1, with a central axis 22 (FIG. 1 only) for mounting the cylinder 12 within the opening 28. As in FIGS. 1 and 2, the cylinder 12 has an outwardly extending cylinder flange 14 for mounting the cylinder 12 within the housing. However, FIG. 3 also shows the heat rejection port 29 through the cylinder 12 that is well known in Stirling machines and is not related to the invention. Similarly, the cylinder of FIG. 3 is thinner on the displacer side (to the left) of the heat rejection port 29 but this too is not related to the invention.

However, in this preferred embodiment the plate 16 is formed with the structural features of the invention in order to accomplish the purpose and object of the invention. An elastic rim 30 that is formed in the plate 16 bounds (forms an inner boundary of) and surrounds the opening 28 and extends, preferably in an axial direction, from the plate 16 to a crest 32 of the rim 30. Preferably and typically the rim 30 is cylindrical and coaxial with the central axis 22 of reciprocation. The crest 32 contacts in engagement against a first axially facing side 34 of the cylinder flange 14. The interior side 36 of the rim 30 is outwardly spaced from the exterior side 38 of the cylinder 12 to provide a space 40 between the rim 30 and the cylinder 12. This space 40 allows some movement of the plate 16 with respect to the cylinder 12 in the event of distortion of the plate 16 in the radial direction 2 or radial rotation direction 3.

A compliant clamp 42 is attached to the transition plate 16 by machine screws 44 that are fastened in threaded holes 46. The compliant clamp 42 is positioned on the opposite, axially facing side 48 of the cylinder flange 14. The compliant clamp 42 comprises an annular ring 50 surrounding the cylinder 12 and fastened against the axially facing end surface 54 of the plate 16. The ring 50 is spaced from the opposite, axially facing side 48 of the cylinder flange 16 so that an elastic spring 52 can extend from the annular ring 50 to the cylinder flange 14. The spring 52 is in compression so it applies a force urging the cylinder flange 14 in an axial direction against the crest 32 of the elastic rim 30. The preferred spring 52 is a wave spring but various other kinds of springs can be used to form a compliant clamp to push the cylinder flange firmly against the crest 32 of the elastic rim 30.

Although the elastic rim 30 can be formed or constructed in a variety of ways, it is preferably and most conveniently formed as an integral part of the plate 16. A circular groove 56 is machined into the plate 16 in an axial direction to extend coaxially around the opening 28 in order to form the elastic rim 30 between the groove 56 and the interior side 36 of the rim 30.

It is not necessary that the elastic rim 30 be formed as an integral part of the plate 16. Instead, the rim 30 can be formed as a separate part. For example, FIG. 5 shows, in phantom lines, a separation line 58 that defines a rim component 60 that is separate from a transition plate 16A. The rim component 60 is clamped by the annular clamping ring 50 against the transition plate 16A. As another alternative, the elastic rim 30 and the compliant clamp 42 can be discontinuous arcuate segments instead of the preferred continuous annular structures. As yet another alternative, the rim can be formed with circularly arranged, spaced apart elastic fingers that may, for example, appear in a cross section through the fingers like the rim in the figures but be like castling.

The invention operates to accomplish the purposes of the invention because it maintains the axial position of the cylinder in the housing but will not distort the cylinder from radial translation or radial rotation of the housing or any other component part that contacts the cylinder or its flange. In other words it is rigid in the axial direction 1, but elastic (compliant) in the radial direction 2 and elastic in the radial rotation direction 3.

The invention provides rigidity in the axial direction because the cylinder flange 14 is held against the crest 32 of the elastic rim 30. Axial force against the rim 30 that is applied by the cylinder flange 14 is applied in a direction that is longitudinal along the rim. That force is strongly resisted by the rim 30 because the rim will not bend but rather can only compress because an axial force applies no bending force against the rim 30.

However, forces applied in the radial direction 2 and in the radial rotation direction 3 are in a direction urging the bending of the rim 30. So the rim 30 can bend in response rather than applying a force against the cylinder 12 or its flange 14. The rim 30 is elastic in those directions because the circular groove 56 is positioned sufficiently close to the interior side 36 of the rim 30 to make the rim 30 sufficiently thin that it provides elasticity in a bending direction. Because of the temperatures and pressures encountered by Stirling machines, their internal mechanical parts are constructed of a metal. Metals have a characteristic known as elasticity. Elasticity means that the metal, when subjected to a force, will deform and when the force is removed will return to its original shape. The stress applied to a metal is directly proportional to its strain, which are related to each other by the proportionality constant for the metal known as its modulus of elasticity (Young's modulus). This property of elasticity remains unless the strain causes the metal's elastic limit to be exceeded. Therefore, the elastic rim 30 can bend like a cantilevered spring and the spring constant for that spring is a function of both the elasticity of the metal and the thickness of the elastic rim 30. Consequently, the designer who is implementing the invention can position the circular groove 56 a distance from the interior side 36 of the elastic rim that gives a rim thickness that in turn provides a desired spring constant. The desired spring constant will permit the elastic rim to bend without exceeding the elastic limit when the transition plate 16 is distorted by temperature or pressure and to return if and when that distortion ceases to exist. The preferred rim thickness and its resulting spring constant will be different for different Stirling machines because different Stirling machines will subject the elastic rim to different forces. Ultimately, the rim thickness can be determined by experimentation, testing and trial and error methods. In addition to the compliance characteristic of the elastic rim 30, the space 40 between the rim 30 and the cylinder 12 also allows some movement of the cylinder 12 in the radial direction 2 and in the radial rotation direction 3.

In summary, the invention minimizes distortion to the cylinder when the machine is pressurized or heated. It has a local mounting seat at the crest 32 which is rigid in the axial location but has flexibility in the lateral on-axis direction as well as being locally compliant to on-axis rotation. It applies an axial force to seat the flange of an engine cylinder against the rim.

REFERENCE NUMBER KEY

10 housing
12 cylinder
14 cylinder flange
16 housing transition plate
18 machine screws attaching cylinder flange 14
20 piston
21 displacer
22 central axis
23 backspace
24 cylinder wall distortion contour
26 rectangle (FIG. 1)
28 opening in transition plate
29 heat rejection port
30 elastic rim
32 crest of rim 30
34 first axially facing side of cylinder flange 14
36 interior side of rim
38 exterior side of cylinder 12

40 space between rim 30 and cylinder 12
42 compliant clamp
44 machine screws attaching clamp 42
46 threaded holes for screws 44
48 opposite axially facing side of cylinder flange 14
50 annular clamping ring
52 spring
54 end surface of plate 16
56 circular groove
58 separation line separating two parts
60 separate rim component of the invention This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved free-piston Stirling machine 1 having a cylinder mounted within a housing, the cylinder having an outwardly extending cylinder flange for mounting the cylinder within the housing, the housing including a plate having an opening with a central axis for mounting the cylinder within the opening, wherein the improvement comprises:

(a) an elastic rim bounding and surrounding the opening and extending from the plate to a crest of the rim, the crest being in engagement against a first axially facing side of the cylinder flange, the interior side of the rim being outwardly spaced from the exterior side of the cylinder wherein a circular groove extends coaxially around the opening and into the plate in an axial direction to form the elastic rim between the groove and the interior side of the rim; and (b) a compliant clamp attached to the plate and positioned on the opposite, axially facing side of the cylinder flange, the compliant clamp having an elastic spring extending against the cylinder flange and applying a force urging the cylinder flange in an axial direction against the crest of the elastic rim.

2. An improved free-piston Stirling machine 1 in accordance with claim 1 wherein the clamp comprises:

(a) a ring surrounding the cylinder, fastened to an axially facing end surface of the plate and spaced from the opposite, axially facing side of the cylinder flange; and (b) at least one spring extending and in compression between the ring and the opposite, axially facing side of the cylinder flange.

3. An improved free-piston Stirling machine in accordance with claim 2 wherein the rim is cylindrical and coaxial with the central axis of reciprocation.

4. An improved free-piston Stirling machine in accordance with claim 3 wherein the spring is a wave spring.

5. An improved free-piston Stirling machine in accordance with claim 1 wherein the clamp comprises:

(a) a ring surrounding the cylinder, fastened to an axially facing end surface of the plate and spaced from the opposite, axially facing side of the cylinder flange; and (b) at least one spring extending and in compression between the ring and the opposite, axially facing side of the cylinder flange.

6. An improved free-piston Stirling machine in accordance 1 with claim wherein the rim is cylindrical and coaxial with the central axis of reciprocation.

7. An improved free-piston Stirling machine in accordance with claim 6 wherein the spring is a wave spring.

* * * * *